US011627823B1

(12) United States Patent
Markman

(10) Patent No.: US 11,627,823 B1
(45) Date of Patent: Apr. 18, 2023

(54) AUTOMATED PACKAGE DELIVERY RECEPTACLE

(71) Applicant: Robert Steven Markman, Northridge, CA (US)

(72) Inventor: Robert Steven Markman, Northridge, CA (US)

( * ) Notice: Subject to any disclaimer, the term of this patent is extended or adjusted under 35 U.S.C. 154(b) by 0 days.

(21) Appl. No.: 17/812,819

(22) Filed: Jul. 15, 2022

(51) Int. Cl.
*A47G 29/22* (2006.01)
*A47G 29/30* (2006.01)
*A47G 29/14* (2006.01)

(52) U.S. Cl.
CPC ..... *A47G 29/22* (2013.01); *A47G 29/141* (2013.01); *A47G 29/30* (2013.01); *A47G 2029/145* (2013.01)

(58) Field of Classification Search
CPC ..... A47G 29/141; A47G 29/20; A47G 29/22; A47G 29/30; A47G 29/12095; A47G 2029/145; B64F 1/32; B64C 39/024
USPC ..... 232/17, 19, 45; 340/569
See application file for complete search history.

(56) References Cited

U.S. PATENT DOCUMENTS 10,028,606 B1 * 7/2018 Ritchie ..... G07C 9/00912
10,835,046 B2 * 11/2020 Chasnis, II ..... G01S 17/04
10,993,567 B1 * 5/2021 Cabral-McKeand ..... A47G 29/20
11,091,309 B1 * 8/2021 Vallery ..... B64C 39/024
11,259,663 B2 * 3/2022 Gil ..... A47G 29/22
2015/0175276 A1 * 6/2015 Koster ..... B64F 1/32 244/114 R
2015/0183528 A1 * 7/2015 Walsh ..... A47G 29/14 244/114 R
2016/0159496 A1 * 6/2016 O'Toole ..... B64C 39/024 244/110 E
2017/0116568 A1 * 4/2017 Pleis ..... A47G 29/14
2018/0070753 A1 * 3/2018 Eveloff ..... H04W 4/025
2018/0092484 A1 * 4/2018 Lewis ..... B64C 39/024
2018/0225628 A1 * 8/2018 Roy ..... A47G 29/141
2019/0300202 A1 * 10/2019 High ..... G06Q 10/08
2019/0343317 A1 * 11/2019 Cantrell ..... G07C 9/00563
2020/0005238 A1 * 1/2020 Richardson ..... G06Q 10/0836
2020/0048951 A1 * 2/2020 Herschap ..... G07C 9/38
2020/0281386 A1 * 9/2020 Knox ..... A47G 29/22
2020/0390260 A1 * 12/2020 Romanucci ..... A47G 29/30
2021/0007523 A1 * 1/2021 Baek ..... A47G 29/141
2021/0030185 A1 * 2/2021 Rogers ..... G06Q 10/083
2021/0228009 A1 * 7/2021 Nakanishi ..... E05B 47/00
(Continued)

*Primary Examiner* — William L Miller

(57) ABSTRACT

The automated package delivery receptacle provides a faster, easier, more delivery-person friendly, and more reliable method of ensuring that packages delivered to unattended locations are not stolen by porch pirates. The receptacle automatically detects any package that is placed on top of it. As soon as the person who delivered the package has departed, the top surface lifts up above the body of the receptacle, rotates to a vertical position, and drops the package into the interior compartment. The top then reverses its motion and returns to its resting horizontal position, locked and ready for another delivery. The receptacle's mechanism does not encroach at all on the receptable's interior compartment space while cycling. It is powered by a 12-volt automobile type battery connected to a motor controller that is programmed to drive a high-speed linear
(Continued)

actuator to complete its open/close cycle in less than twenty seconds.

3 Claims, 13 Drawing Sheets

(56) References Cited

U.S. PATENT DOCUMENTS

2021/0394930 A1* 12/2021 O'Toole ..... G05B 15/02

* cited by examiner

AUTOMATED PACKAGE DELIVERY RECEPTACLE

BACKGROUND SECTION

This invention is in the field of secured package delivery devices

Packages are frequently left by delivery persons on porches near the front door of unattended residences. Many of these packages are stolen. For this reason, secure package receptacles are increasingly being used by homeowners. These receptacles are only effective if they do not require delivery personnel to take any extra effort or time when making their deliveries.

Delivery persons vary in their interest in providing good customer service. Due to labor shortages and tight schedules, they are under increasing pressure to spend the least amount of time possible at each delivery location. Consequently, they don't want to spend time with extra scans, waiting for a code to unlock a receptacle, opening a receptacle to insert a package, or following some other extra procedure. Some delivery persons wear wide brimmed sunhats that block their peripheral view as they concentrate on the owner's front door, and they don't even notice posted written instructions or the package receptacles themselves. Some porch pirates closely shadow delivery vans and are able to steal unsecured packages seconds after they are delivered.

Some secure receptacles require the delivery person to put in a code, open the receptacle, place the package in it and then close and lock it-something many delivery persons are not willing to do. Other receptacles on the market are simple hoppers similar to the UPS and USPS receptacles in that they require the delivery person to open the receptacle and place the package inside. The mechanical theft protection shielding devices used by most of these receptacles wastes up to 40% of their interior volume. Some devices on the market sense that a package has been placed on top of a designated placement surface, but they do not protect the package from theft, functioning only as a notification device, informing the user that a package has been delivered. Some devices are containers with lockable lids that must be left open to receive a package and must be closed and locked by the delivery person and can only secure one package before being emptied by the device's owner. There are some drone delivery systems described that have receptacles that automatically open and close by either a simple hinge mechanism or using a horizontal rolling door; however, they all require communication and coordination with the delivery drone.

Thus, there is a need for improvements. The invention presented in this patent application solves the problems described by autonomously and rapidly securing delivered parcels while at the same time, greatly reducing the opportunity for theft without adding any time or effort burden to delivery personnel.

BRIEF SUMMARY OF THE INVENTION

The invention is a secure container that detects delivered packages placed on its receiving surface. The receiving surface automatically lifts up and rotates into a vertical position, exposing the receptacle's interior compartment. The packages are dropped into the receptacle, the receiving surface returns to its resting position, securely locking the packages inside the receptacle The invention's mechanism operates completely exterior to the receptable's large storage compartment, ensuring that the full interior compartment is available to store a large volume of packages. In its preferred embodiment the invention employs a 12-volt storage battery to power a high-speed linear actuator that opens and closes the receptable in less than twenty seconds, rapidly securing delivered packages.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
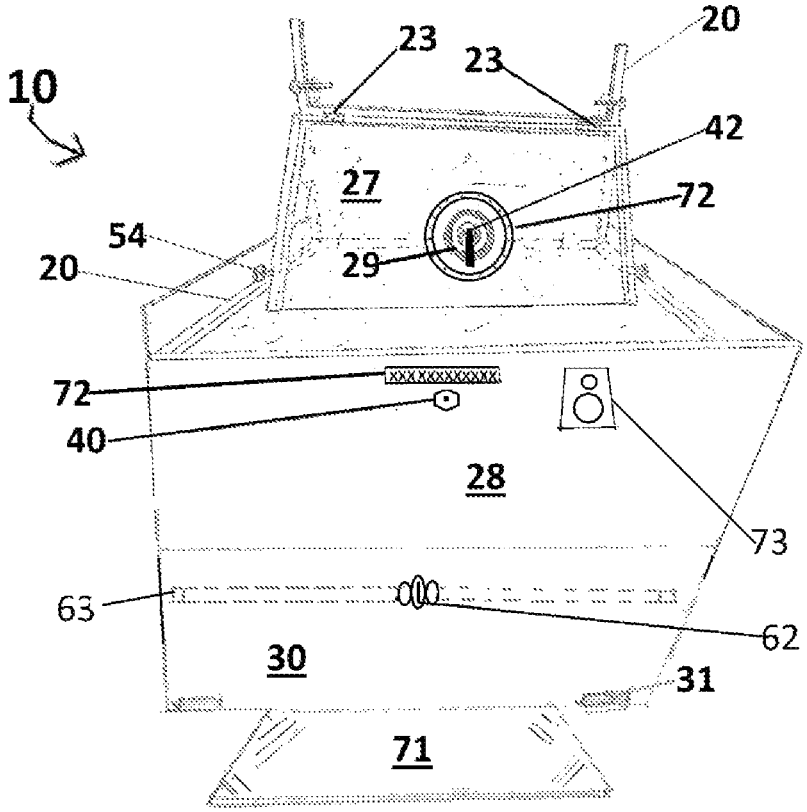
FIG. 1 is a frontal bird's eye perspective view of the receptacle shown in a partially open state

10. Receptacle
20. Receptacle frame
21. Top panel frame
22. Drawer slides having their stationary sections fixed vertically to the vertical rear frame members and having their sliding sections fixed at their uppermost ends to a horizontal lifting plate (61)
23. top panel hinges
24. Back panel
25. Hold-down brackets
26. Side panels (with extensions)
27. Top panel
28. Upper front panel
29. Target
30 Front access panel
31. Front access panel hinges
32. notification flag
33. Upper sliding portion of drawer slide
35. Fixed lower section of drawer slide

36. Keyed on-off power switch
40. Passive infrared sensor
41. Bottom panel
42. Limit switch
44. Reflective laser sensor
46. Capacitive proximity sensor
47. Sliding pin mechanism
48. Linear actuator
49. Linear actuator rod attachment bracket
51. Linear actuator body attachment bracket
52. Drawer slide stabilizing roller
54. Track rollers
56. Hold-down brackets
59. Direction changing guide bracket
60. U-shaped lifting body
61. Horizontal lifting plate
62. keyed access panel lock
63 access panel locking bar
64. AC power source
65. Battery charger
66. Solar panel
68. Battery
70. Motor controller
71. Pressure sensitive mat
72. LED strip
73. Loudspeaker
74. Delivered package

DETAILED DESCRIPTION OF THE INVENTION

The preferred embodiment of this invention is depicted within FIGS. 1 through 13. However, the invention is not limited to the described embodiment, and a person skilled in the art will appreciate that many other embodiments of the invention are possible without deviating from the basic concept of the invention and that any such work around will also fall under the scope of this invention. It is envisioned that other styles, configurations and sizes of the present invention can be easily incorporated into the teachings of the present invention, and only one (1) particular configuration shall be shown for the purposes of clarity and disclosure and not by way of limitation of scope. All of the implementations described below are exemplary implementations, provided to enable persons skilled in the art to make or use the embodiments of the disclosure and are not intended to limit the scope of the disclosure which will be defined by the claims that follow.

The terms "a" and "an" herein do not denote a limitation of quantity, but rather denote the presence of at least one (1) of the referenced items.

Referring now to FIG. 1, a frontal perspective view depicts the receptacle (10) in a partially opened state. On or near the receptacle (10) a sign is prominently posted reading: "Delivery persons: Please place your package on the target". As a delivery person approaches the receptacle (10), a passive infrared sensor (40) on the upper front panel (28) and a pressure sensitive mat (71) adjacent to and in front of the receptacle (10) work in concert to trigger LED lights (72) to flash repeatedly both on the front panel and on the top panel surrounding an imprinted target (29) while also triggering a loudspeaker (73) announcement: "Please leave your package on the target". In the preferred embodiment, any package weighing at least 1½ ounces that is left on the target (29) triggers the limit switch, causing the receptacle (10), after a programmed brief delay, to open in the following manner: the hinged rear edge of the top panel (27) is pushed upwards by a linear actuator, causing the front surface of the top panel (27) to move backwards, guided by the track rollers (54) that rest on and move along the top surfaces of the upper horizontal portions of the frame (20). When the linear actuator's rod reaches full extension the top panel (27) has swung down on its hinges (23) to a fully vertical position with its front edge reaching the rearmost part of the receptacle. Once the linear actuator rod reaches full extension, it immediately reverses itself and retracts until the top panel (27) is returned to its original position where it slips under two hold-down brackets (56). The whole cycle takes less than 20 seconds, during which packages placed on the top panel (27), fall into the receptacle, and are safely secured. The mechanical limit switch (42) is fixed on the top panel within the bullseye of a the clearly displayed target (29) rendered on the center of the top panel's (27) surface. When packages are placed on the target (29), the limit switch is activated, triggering a motor controller (70) to perform its program. The motor controller (70) delays the linear actuator (48) rod's extension until the programmed parameters are reached. In the preferred embodiment, the linear actuator (48) is actuated 10-20 seconds after the package has been left on the target. By this time, the delivery person has started walking away and it is unlikely that a porch pirate has followed so closely that he can steal the package before it is safely deposited. In another embodiment, the linear actuator (48) is not actuated until a passive infrared sensor (40) mounted inside the receptacle's front panel at chest height, notifies the motor-controller (70) that it no longer detects a heat signal. A preferred embodiment used to illustrate the invention consists of a receptacle that is 29 inches deep, 51 inches in height and 46 inches in length. The linear actuator rod (48) in this preferred embodiment has 24 inches of travel. These specifications are only provided as an example and are not meant to limit the invention to any particular size.

Figure 2:
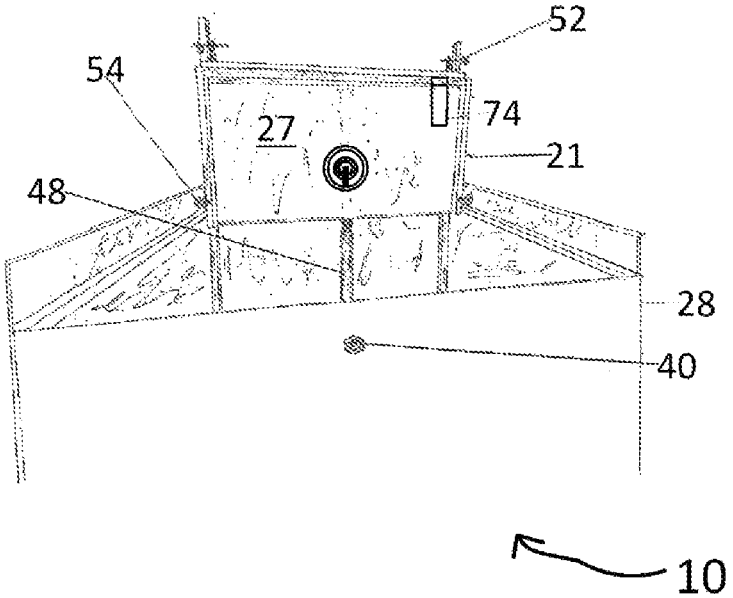
FIG. 2 is a frontal bird's eye perspective view of the receptacle shown in a fully open state

Referring to FIG. 2, a bird's eye perspective view of the receptacle in its fully open state. The top panel (27) is rotated to a fully vertical position. The linear actuator (48) is visible inside the receptacle.

Figure 3:
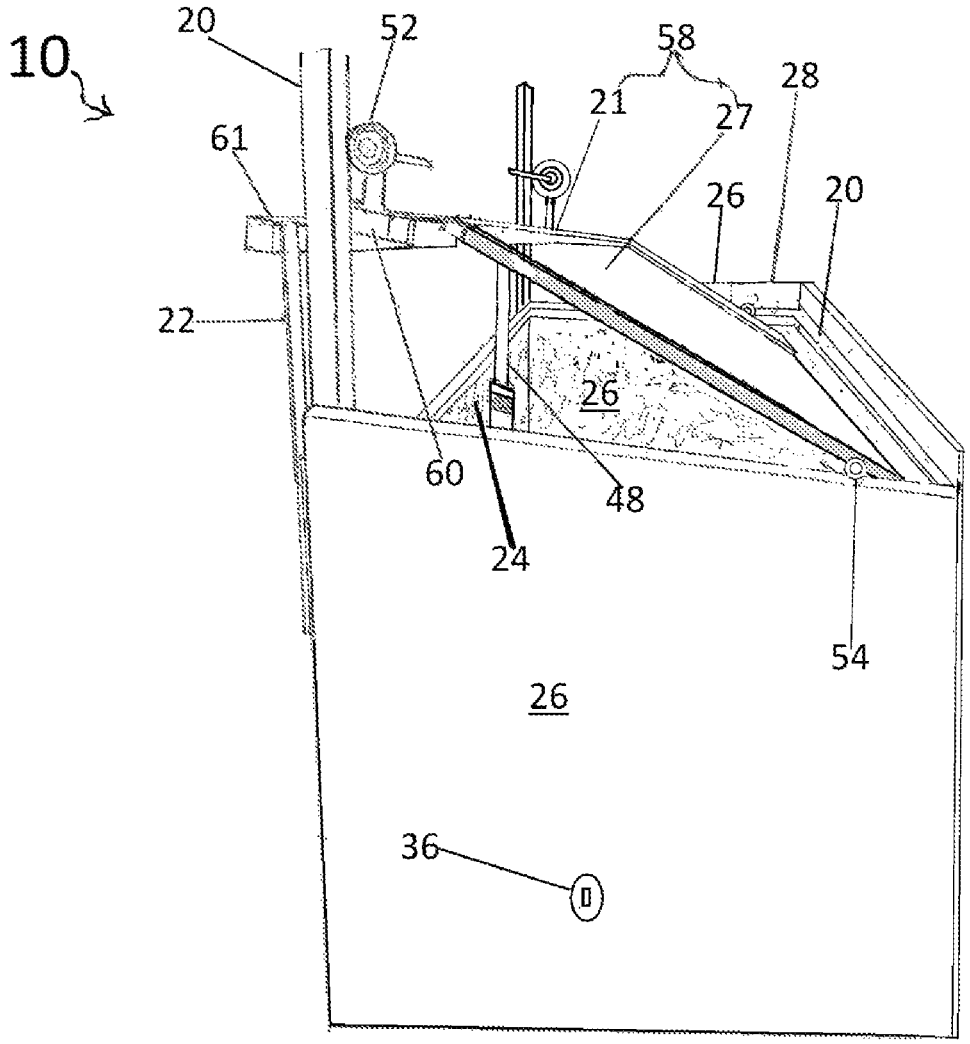
FIG. 3 is a detailed perspective side view of the receptacle shown partially opened
Figure 4:
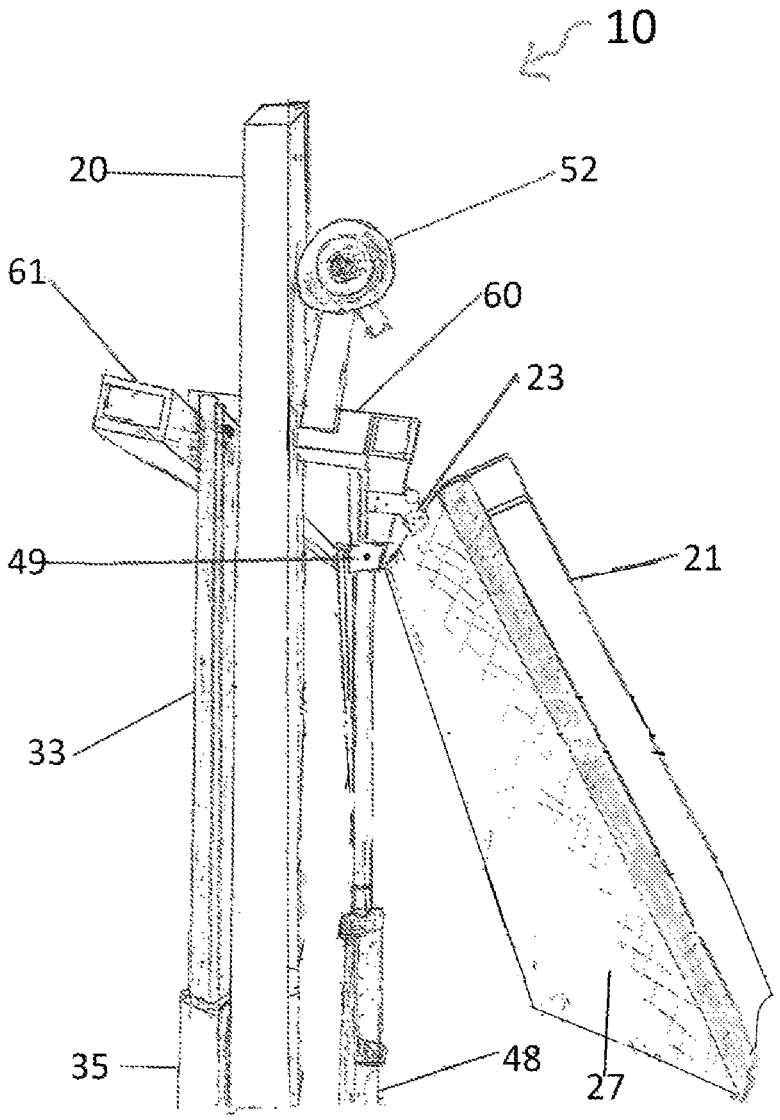
FIG. 4 is a detailed perspective side view of the moving components of the partially open receptacle

Referring to FIG. 3, a perspective side view of the partially open receptacle. The partially extended linear actuator rod (48) is visible. There is a drawer slide (22) mounted vertically on each of the two rear lower vertical portions of the frame (20). The portions of the drawer slides that extend upwards are free floating but are restrained by the drawer slide stabilizing rollers (52) that ride up the front surfaces of the upper portions of the vertical rear sections of the frame (20). These drawer slide stabilizing rollers (52) are fixed to the upper surface of the legs of a U-shaped lifting body (60). This U-shaped lifting body is in turn fixed to the top panel frame (21) by two top panel hinges (23) which are illustrated in FIG. 1 and FIG. 4. The top panel frame (21) holds the top panel (27) in place using multiple attachment points so that the top panel is kept flush with the top panel frame (21). The legs of the U-shaped lifting body (60) are in turn fixed to the horizontal lifting plate (61) which in turn is fixed to the upper ends of the free-floating sliding portions of the drawer slides (22).

Figure 6:
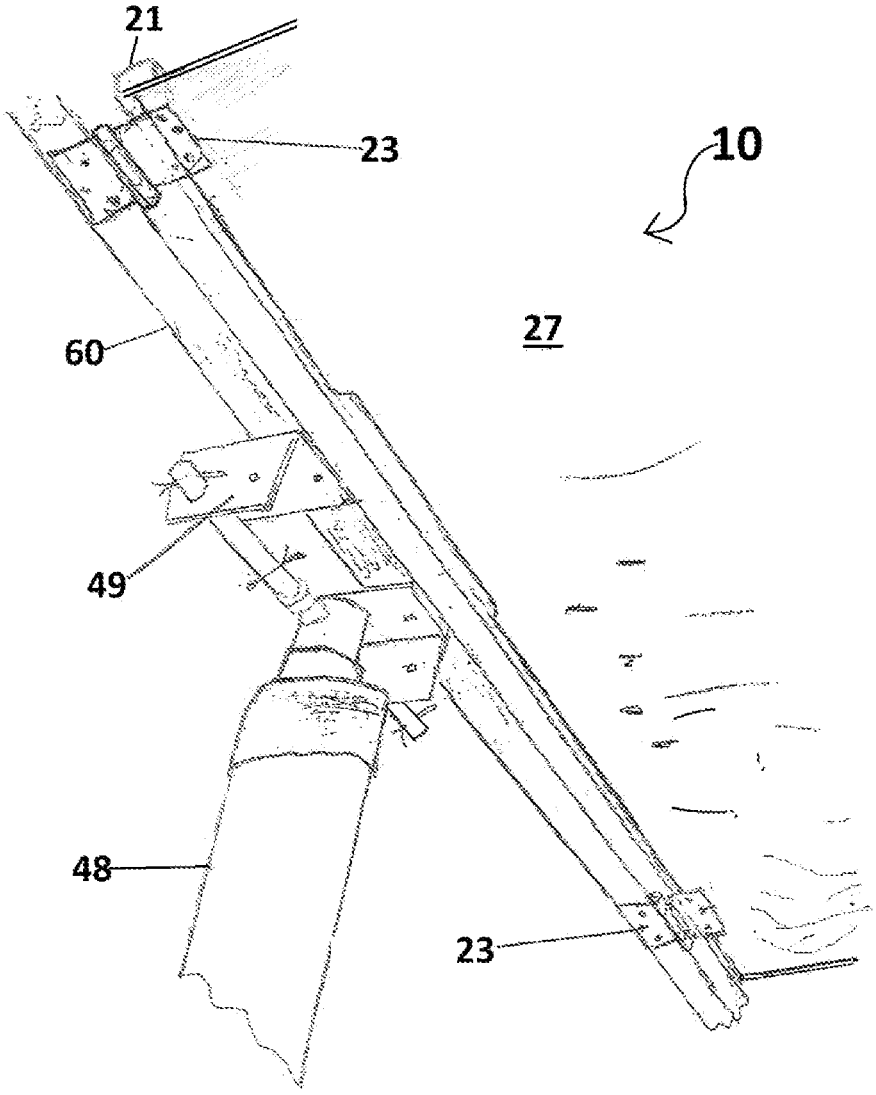
FIG. 6 is a perspective view from below looking up at the linear actuator rod attachment bracket

The top of the linear actuator's rod (48) is fixed to the U-shaped lifting body (60) by the linear actuator rod attachment bracket (49) that incorporates a sliding pin mechanism as illustrated in FIG. 6. When the linear actuator's rod (48) starts to extend from its fully retracted position, it pushes up the U-shaped lifting body (60). As the U-shaped lifting body (60) is pushed up, it lifts the attached top panel (27) with it, stabilized by the drawer slides (22) which are fixed to the horizontal lifting plate (61). The horizontal lifting plate is in turn fixed to both of the U-shaped lifting body's (60) legs. This combination produces smooth travel up and down for the top panel (27). A keyed on-off power switch (36) is accessible to the user on a side panel.

Referring to FIG. 4, a perspective side view of the moving components of the receptacle in a partially opened state illustrates the details of the mechanical connections between the rear vertical portion of the frame (20), the stationary sections of the drawer slides (35), the horizontal lifting plate (61), the U-shaped lifting body (60), the top panel (27), the linear actuator (48), and the drawer slide stabilizing rollers (52).

Figure 5:
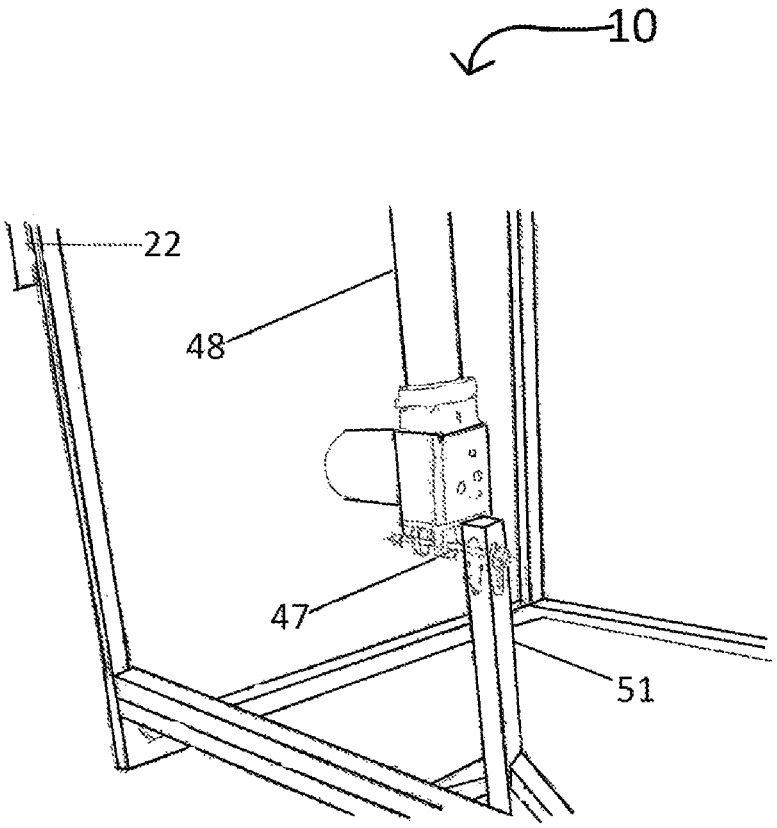
FIG. 5 is a perspective view of the lower end of the linear actuator body and its attachment to the receptacle's frame

Referring to FIG. 5, is a perspective view of the lower end of the linear actuator's body and its attachment to the receptacle's frame showing the details of the floating linear actuator (48) body's attachment bracket (51) that allows the linear actuator to smoothly and quietly move the top panel up and down, eliminating any jerking movement upon starting and stopping.

Referring to FIG. 6, a perspective view from below looking up at the linear actuator (48) rod attachment bracket (49) showing the upper portion of the linear actuator (48) including the upper end of the linear actuator's body, the almost fully retracted linear actuator (48)'s rod and the linear actuator rod attachment bracket (49) that allows a degree of lateral travel that contributes to the smooth operation of the device. This bracket (49) is fixed to the middle of the of the U-shaped lifting body (60). The U-shaped lifting body (60) is connected by two hinges to the top panel frame (21) by bolts that pass through the top panel (27) and then through the top panel frame (21). This view also demonstrates the attachment of the top panel hinges (23) to the U-shaped lifting body (60) that allows the top panel (27) to rotate into a vertical position as it is pushed vertically upward.

Figure 7:
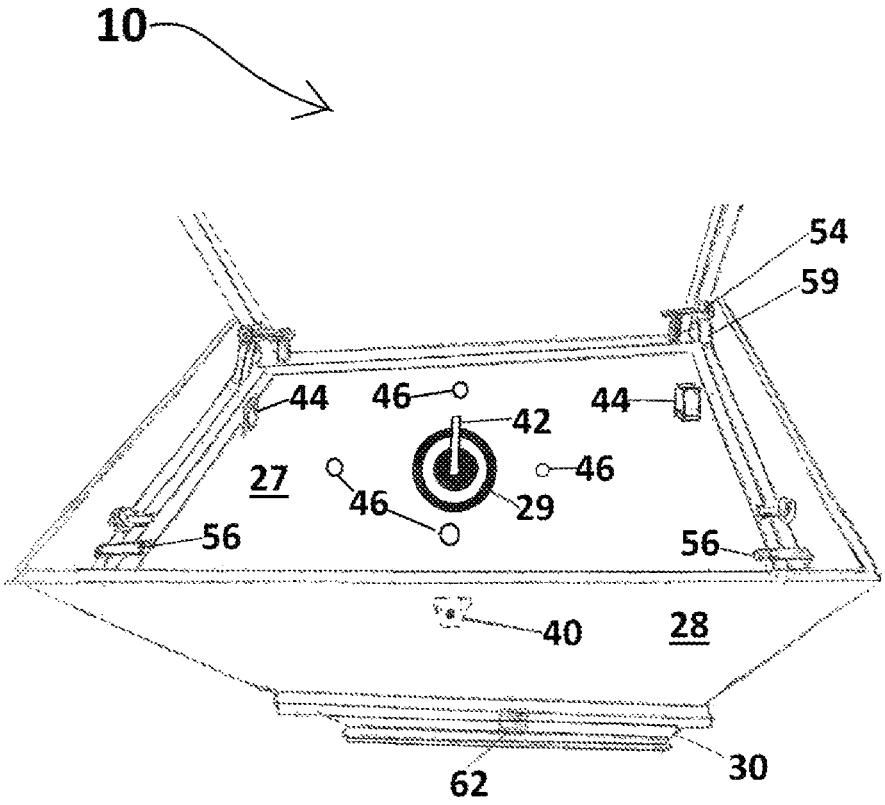
FIG. 7 is a bird's eye perspective frontal view of the invention in its fully closed state

Referring to FIG. 7, a perspective bird's eye view of the receptacle from the front with the top panel (27) fully closed. Two direction changing guide brackets (59) allow the track rollers (54) that guide the top panel (27) to smoothly transition from vertical movement down to horizontal movement without getting hung up as the fully extended linear actuator (48)'s rod reverses itself while the top panel is momentarily being held vertically. When the top panel (27) closes the receptacle by moving to its resting position, the front leading edge of the top panel frame (21) slips under the hold-down brackets (56), securing the top panel in place. When not operating, the rear portion of the top panel (27) cannot be moved because it is mechanically fixed to the linear actuator (48) which firmly resists movement while it is not actuated. Also, in FIG. 7 are shown some of the sensors that can be added to additional embodiments of the invention, including a reflective laser sensor (44) and an array of capacitive proximity sensors (46) embedded in the top panel (27) with the surface of these sensors mounted flush with the upper surface of the top panel (27). The target (29) is shown and at its center is shown the limit switch (42).

On the front panel is shown an embedded passive infrared sensor (40) that as previously mentioned can be configured with the motor controller (70) to delay opening the receptacle until there is no person sized heat signature being picked up in the immediate vicinity of the receptacle. A keyed access panel lock (62) and access panel locking bar (63) mounted on the front access panel (30) keeps the front access panel (30) locked closed and packages secure until an authorized user unlocks the front access panel (30) and swings it down to retrieve the stored packages.

Figure 8:
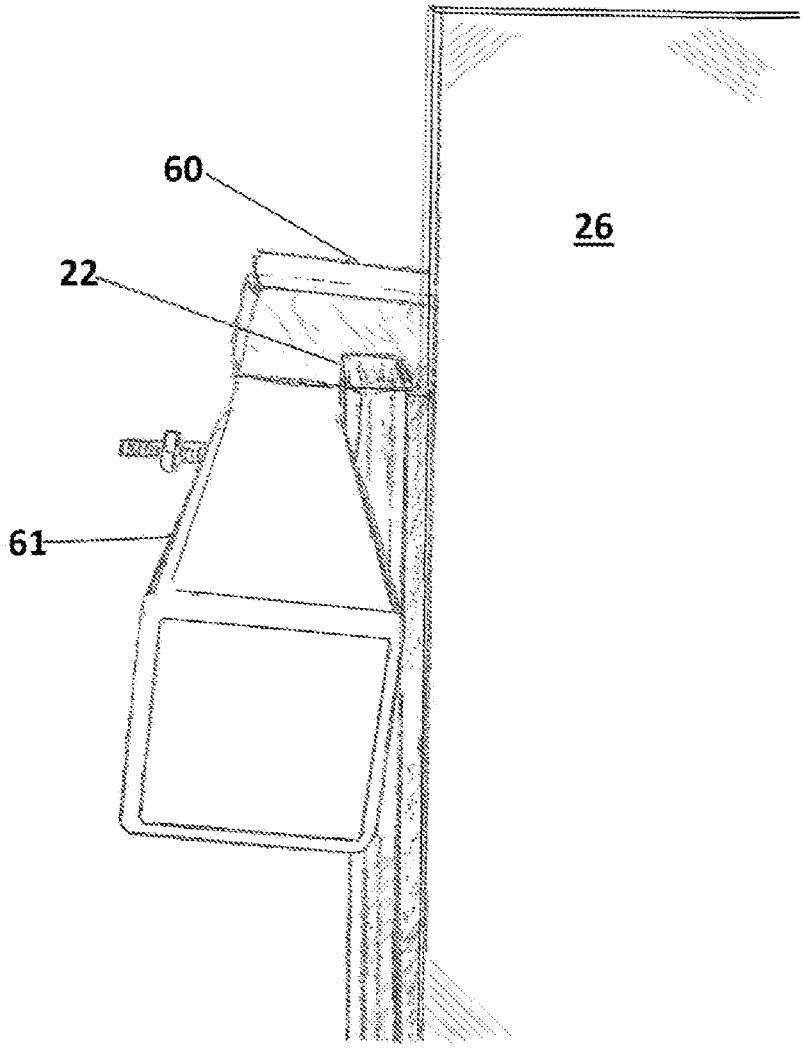
FIG. 8 is a perspective view of the attachment of the sliding upper section of one of the drawer slides to the horizontal lifting plate

Referring to FIG. 8, a perspective view of the attachment of the sliding upper section of one of the drawer slides (22) to the horizontal lifting plate (61). This horizontal lifting plate (61) is attached to the end of one of the legs of the U-shaped lifting body (60).

Figure 9:
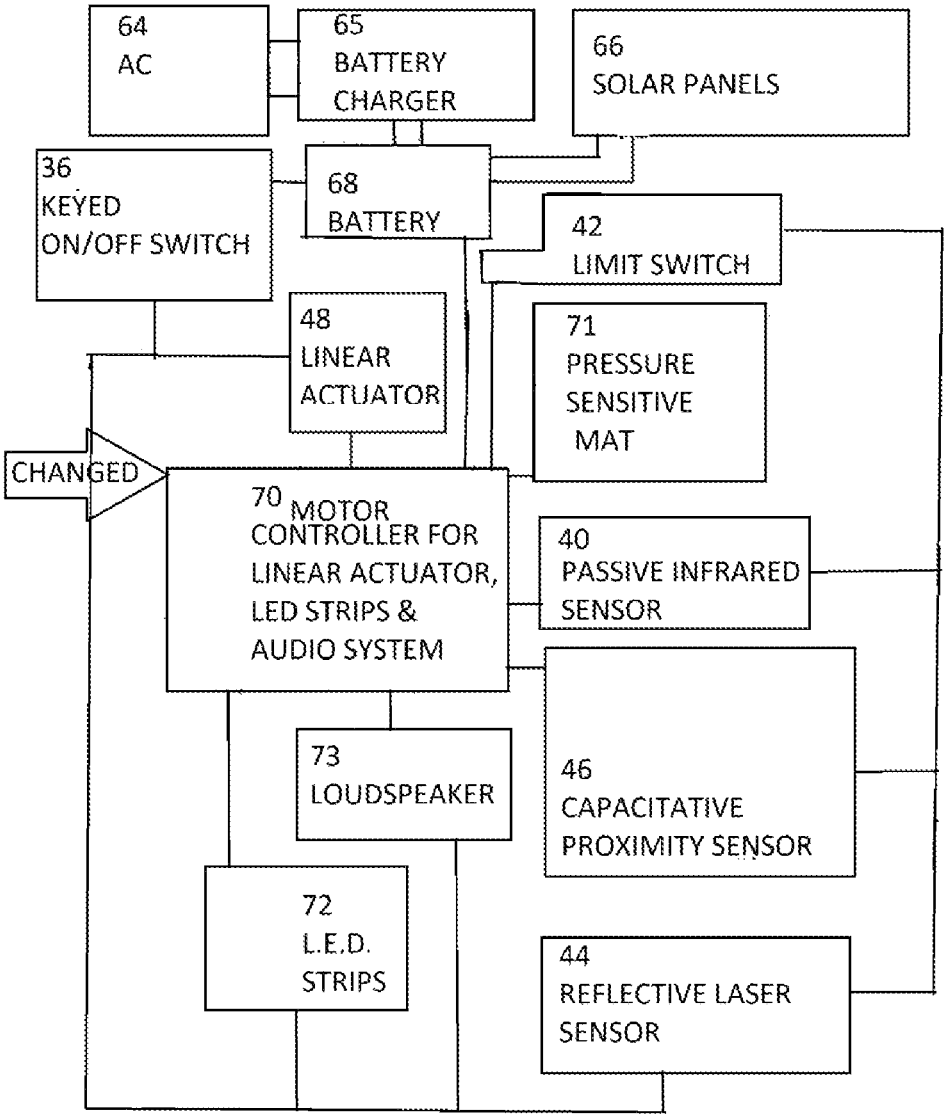
FIG. 9 is an electrical block diagram demonstrating both the basic and the optional features of the preferred embodiment

Referring to FIG. 9, an electrical block diagram is disclosed. It demonstrates the electrical and electronic components of the preferred embodiment of the receptacle (10) which are: a keyed on-off switch (36), a battery (68), a linear actuator (48), a limit switch (42), a passive infrared sensor (40), and a motor controller (70). Additional components of alternate embodiments include but are not limited to a permanent AC power supply (64), an internal battery charger (65), a solar panel (66), reflective laser sensors (44), capacitive proximity sensors (46), a pressure sensitive mat (71), LED strips (72), and a loudspeaker (73).

A short (10-20 second) time delay can be programmed into the motor controller (70) so that the linear actuator does not start its operation while the delivery person is still present but will start and finish its operation after the delivery person starts walking away but before a "porch pirate" who has been following the delivery person, can swoop in to steal the delivered package. When triggered the motor controller (70) functions to cause the linear actuator (48) rod to move from full retraction to full extension and then to immediately reverse to full retraction. The LED strips (72) and loudspeaker (73) can be activated by the passive infrared sensor (40) and the pressure sensitive mat (71), also utilizing the motor controller (70) when programmed appropriately by persons skilled in the art.

Figure 10:
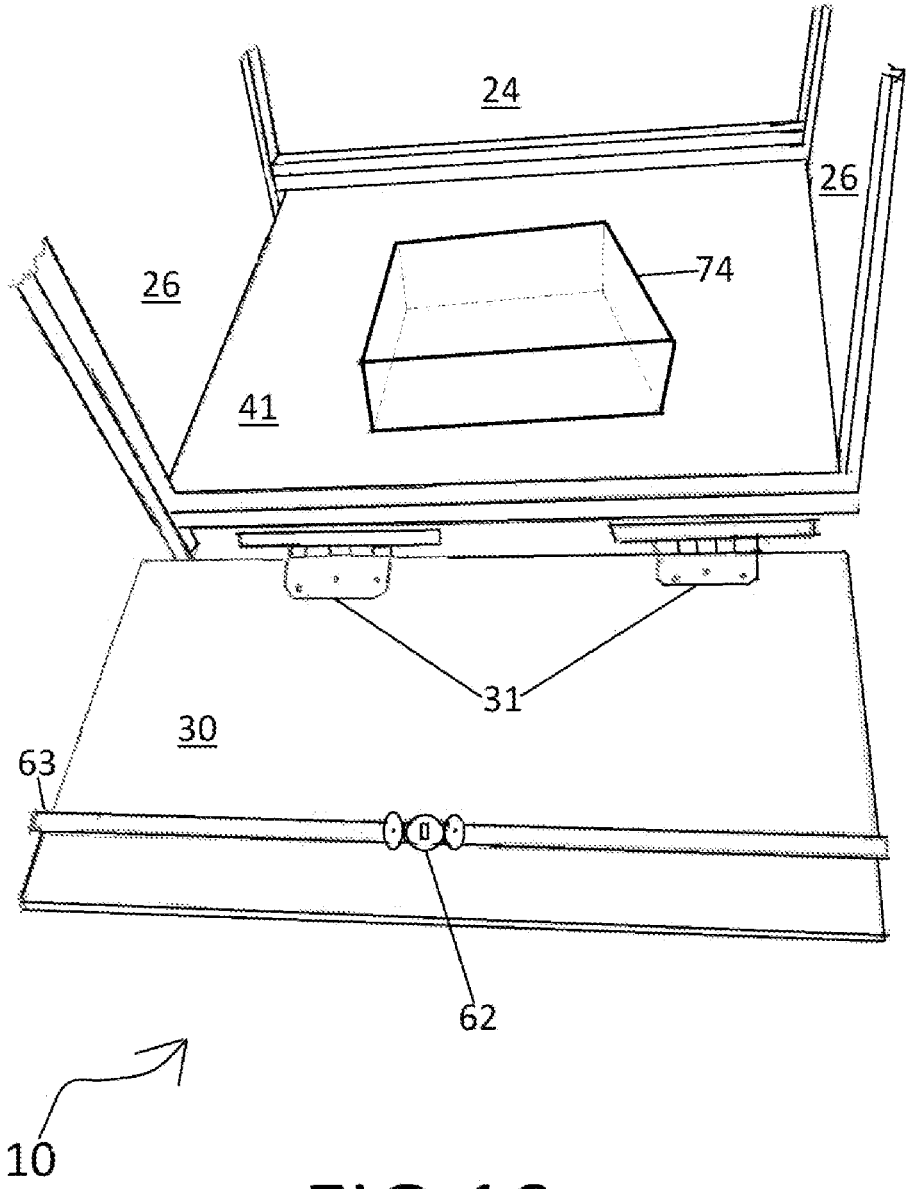
FIG. 10 is a perspective frontal view demonstrating the lower portion of the receptacle with the front access panel in an open position.

Referring to FIG. 10, a perspective frontal view demonstrating the lower portion of the receptacle with the front access panel in an open position. The hinged lower front panel (30) has been swung down to retrieve packages from the receptacle. The side panels (26), the rear panel (24) and the bottom panel (41) are seen fixed to the frame (20). A delivered package (74) is shown secured in the receptacle (10).

Figure 11:
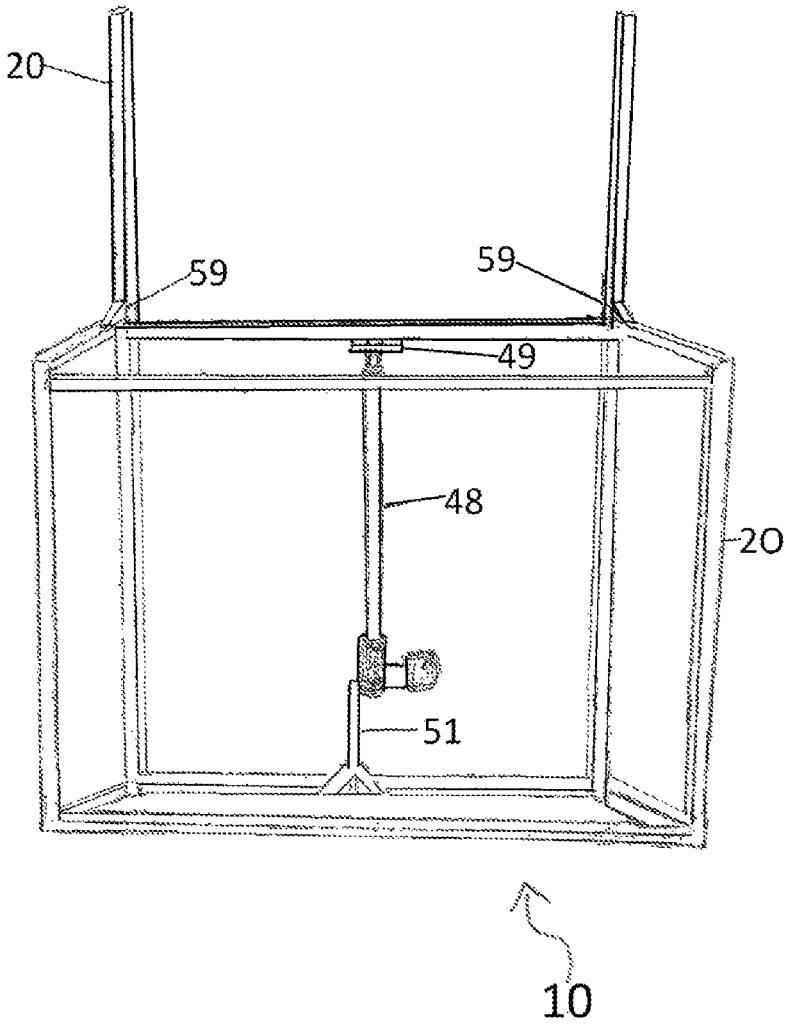
FIG. 11 is a perspective frontal view of the receptacle's frame demonstrating the location of the linear actuator in the preferred embodiment.
Figure 12A:
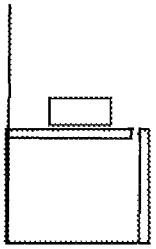
FIG. 12*a*-12*e* are side view schematic drawings demonstrating the various positions of the top panel as it rises and rotates to secure a package.
Figure 12B:
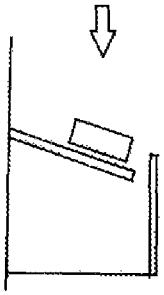
Figure 12C:
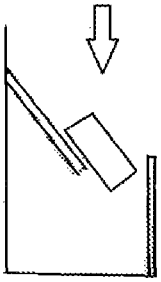
Figure 12D:
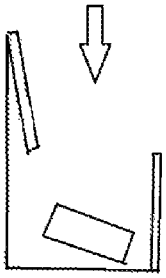
Figure 12E:
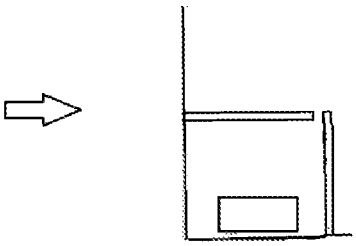

Referring to FIG. 11, a perspective frontal view of the receptacle's frame demonstrating the location of the linear actuator in the preferred embodiment. Demonstrated is the entire frame (20) and the positions of the linear actuator (48), the linear actuator rod attachment bracket (49), and the linear actuator body attachment bracket (51). Also shown is the location of the direction changing guide brackets (59) and their attachment to the frame (20). In the preferred embodiment, the frame (20) is constructed of one-inch square steel tubing. Any number of alternate rigid materials can be used for the frame (20), including stainless steel, aluminum, plastic, wood, or any other suitably strong material.

Referring to FIGS. 12*a* through 12*e*, side view schematic drawings of the preferred embodiment, demonstrating the various positions of the top panel as it rises and rotates to secure a package that has been delivered.

Figure 13:
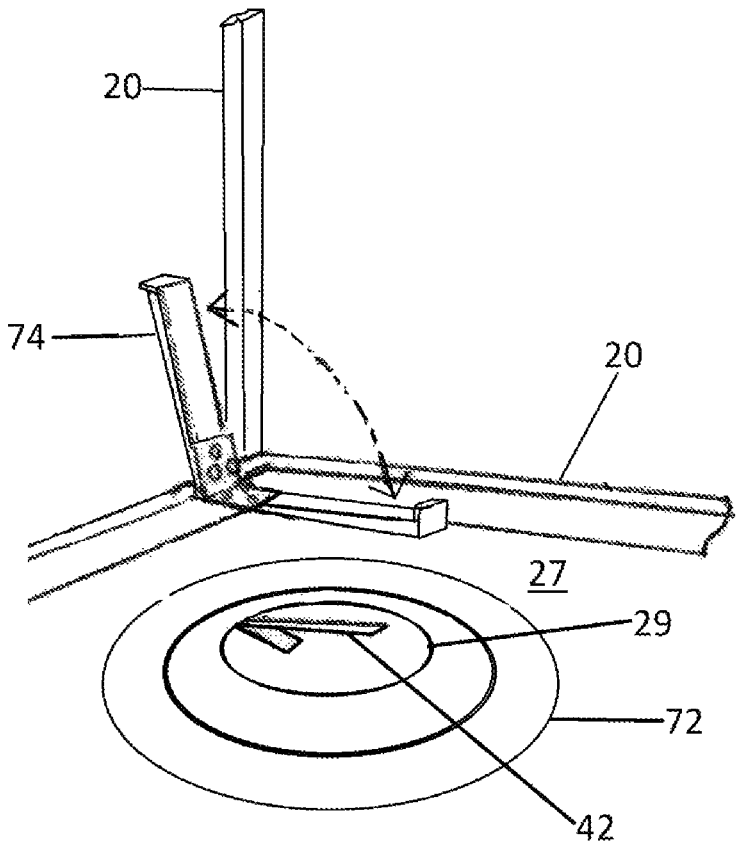
FIG. 13 is a perspective side view of a portion of the top panel.

Referring to FIG. 13, a perspective side view of a portion of the top panel (27) demonstrating the vertical position of the notification flag (32) before a package is delivered and the horizontal position of the notification flag (32) after a package has been secured. Also shown are the limit switch (42), the target (29), and an LED strip (72) encircling the target.

Operation of the Preferred Embodiment

The preferred embodiment of the present invention can be utilized with minimal setup. It is envisioned that the invention would be constructed in general accordance with FIG. 1 though FIG. 13. The user would procure the appropriately sized automated delivery receptacle (10) according to the physical space requirements he has. It would be installed by using standard fastening hardware to a vertical or horizontal surface, or both. Alternatively, it can be secured by placing a sufficient amount of weight plates, sandbags or water filled bladders on top of the bottom panel (41). Electrical hookup to an AC source of power is optional since it is operated by use of an internal storage battery that sits on top of the floor panel. The battery (68) can easily be removed for charging when necessary or alternatively a battery charger (65) can be connected temporarily or permanently as desired.

During utilization of the receptacle, a delivery person would read the simple directions prominently posted on the outside of the upper front panel (28). The directions can state: "Delivery Persons: Please place packages on the target above". Alternatively, the delivery person would be greeted by a loudspeaker (73) announcement instructing him on where to place packages. This announcement could be coordinated with flashing LED strips (72) that surround the target (29) and are also located on the outside of the upper front panel (28). An arrow displayed on the receptacle points up directing the delivery person to the eight inch diameter red and white target (29) displayed on the movable horizontal top panel. In the center of the target the delivery person can see the lever of the imbedded limit switch (42) and intuitively will place the package on top of it. If the package is not set on the limit switch it will still be detected by the capacitive proximity sensors (46) and the reflective laser sensor (44). The delivery person will immediately walk away since nothing happens while he stands in front of it. Ten to twenty seconds after the package is detected or alternatively, after the passive infrared sensor (40) no longer detects a heat source or the pressure sensitive mat no longer senses any substantial weight, the mechanism will begin to cycle, completing its operation in less than 20 seconds. When the end user wants to retrieve his delivered packages, he uses a key to open the hinged front access panel (30).

The foregoing descriptions of specific embodiments of the present invention have been presented for purposes of illustration and description. They are not intended to be exhaustive or to limit the invention to the precise forms disclosed, and obviously, many modifications and variations are possible in light of the above teaching. The embodiments were chosen and described in order to best explain the principles of the invention and its practical application, to thereby enable others skilled in the art, to best utilize the invention and its various modifications as are suited to the particular use contemplated.

The invention claimed is:

1. An automated package delivery receptacle designed to receive and secure packages delivered to an owner comprising:

a cuboid container defining an enclosure comprising a tubular frame, the tubular frame comprised of four lower horizontal frame members, four upper horizontal frame members, two front vertical frame members and two rear vertical frame members, the rear vertical frame members extending vertically upwards above the upper horizontal frame members so that the rear vertical frame members extend a distance above the upper horizontal frame members that is equal to or greater than the length of the front to back dimension of the receptacle;

a bottom panel fixed to the frame;

a back panel, two side panels, and a front panel, all fixed to the frame and coupled together with the bottom panel to form an interior space, wherein the front panel is comprised of an upper section fixed to the frame and a lower section hingedly fixed to the frame; the lower section serving as a lockable access panel;

a rectangular top panel that serves as a lid that securely closes the receptacle;

a top panel frame comprised of a left frame member, a right frame member, a rear frame member and a front frame member, coupled together and fixed to the top panel and configured so that the top panel frame easily fits within the upper horizontal portion of the receptacle's frame;

two track rollers fixed to the top panel frame, one of the track rollers fixed to the front edge of the right frame member, and the other of the track rollers fixed to the front edge of the left frame member, configured so that wheels of the track rollers extend laterally outwards away from the top panel and are configured to roll on top of the upper horizontal portion of the receptacle's frame, the wheels supporting the front of the top panel so that the top panel's front edge is flush with the upper horizontal portion of the receptacle's frame;

two hold-down brackets fixed on the edges of the front of the upper front horizontal frame member, configured to securely hold the front edge of the top panel in place when the receptacle is closed;

a package sensing mechanism comprised of limit switches and capacitive proximity sensors attached to the top panel and configured to detect the presence of packages that are placed on the top panel;

a linear actuator, vertically oriented, configured so that the lower end of a body of the linear actuator is affixed to the front edge of the center of the rear lower horizontal member of the frame, and the upper end of a rod of the linear actuator is affixed to a horizontal lifting plate, which in turn is hingedly attached to the top panel frame's rear frame member and configured so that when the receptacle is closed the rear edge of the top panel frame is horizontal and flush with the upper horizontal portion of the receptacle's frame, thereby maintaining the top panel in a horizontal position;

a motor controller configured to be triggered by the package sensing mechanism to activate the linear actuator so that when the linear actuator is triggered by a signal from the package sensing mechanism to the motor controller, the linear actuator's rod extends from an initial fully retracted position to a fully extended position and then immediately reverses back to its initial fully retracted position, thereby lifting the top panel's rear edge vertically upwards while simultaneously pulling the top panel's front edge to the rear of the receptacle while holding the top panel above the receptacle's interior space by the track rollers that ride on top of the upper front to rear oriented horizontal frame members, thereby causing the top panel to pivot to a vertical position, dropping delivered packages that have been placed on the top panel into the receptacle's interior space and then returning the top panel to its initial horizontal position where the front edge of the top panel is secured as it rolls forwards and slips under the two hold-down brackets;

a theft deterrent mechanism comprising a passive infrared sensor wired to the motor controller which is programmed to prevent the top panel from moving from its closed position while the passive infrared sensor detects a person-sized heat signature in proximity to the receptacle;

a storage battery that is configured to power the sensing mechanism, the theft deterrent mechanism, the motor controller, and the linear actuator;

a solar panel array configured to charge the storage battery; and an AC power supply configured to charge the storage battery when solar energy is insufficient.

2. The automated package delivery receptacle of claim 1, wherein a second theft deterrent mechanism comprising a pressure sensitive mat is secured in front of the receptacle and wired to the motor controller, the motor controller programmed to prevent the top panel from moving from the closed position while the pressure sensitive mat detects a weight of at least 30 pounds on its surface.

3. The automated package delivery receptacle of claim 1, further comprising a notification flag hingedly attached to the top panel, standing upright and perpendicular to the top panel, configured so that when the top panel momentarily flips to a vertical position the flag passively rotates down and lays flat on the top panel, thereby providing a visual indication to the owner that a package has been delivered.

* * * * *